US005406826A

United States Patent [19]

Kuhlmann et al.

[11] Patent Number: 5,406,826

[45] Date of Patent: Apr. 18, 1995

[54] SPREADER DEVICE WITH REPLACEABLE SPREADING JAWS

[75] Inventors: Wolf Kuhlmann, Nurnberg; Christoph Lasaroff, Niederndorf; Dieter Hesse, Erlangen, all of Germany

[73] Assignee: Lukas Hydraulik GmbH, Erlangen, Germany

[21] Appl. No.: 147,889

[22] Filed: Nov. 5, 1993

[30] Foreign Application Priority Data

Nov. 5, 1992 [DE] Germany ..... 9215062 U

[51] Int. Cl.[6] ..... B66F 3/00

[52] U.S. Cl. ..... 72/392; 72/705; 254/104; 30/134

[58] Field of Search ..... 72/392, 705, 477; 254/93 R, 100, 104, 124; 30/134

[56] References Cited

U.S. PATENT DOCUMENTS

| | | | |
|---|---|---|---|
| 4,333,330 | 6/1982 | Porter | 72/392 |
| 4,531,289 | 7/1985 | Brick | 30/134 |
| 4,842,249 | 6/1989 | Weigand | 254/93 R |
| 4,973,028 | 11/1990 | Linster | 254/93 R |
| 5,060,502 | 10/1991 | Kuhlmann et al. . | |
| 5,297,780 | 3/1994 | Hickerson | 254/124 |

FOREIGN PATENT DOCUMENTS

| | | | |
|---|---|---|---|
| 2621249 | 11/1977 | Germany | 72/392 |
| 2111421 | 7/1983 | United Kingdom | 72/392 |

*Primary Examiner*—David Jones
*Attorney, Agent, or Firm*—Ostrolenk, Faber, Gerb & Soffen

[57] ABSTRACT

A so-called rescue spreader is constructed with a pair of replaceable jaws that are mirror images of one another and are operatively positioned back-to-back. Each jaw is generally a triangle having a back side and a front side, with both sides extending from a base and converging at a tip where the sides define an included angle of approximately 20° to 30°. Corrugations on the back side are provided to reduce slippage. The front side along its half length extending from the tip is provided with a plurality of teeth and a circular cam is provided along the other half length of the front side.

12 Claims, 1 Drawing Sheet

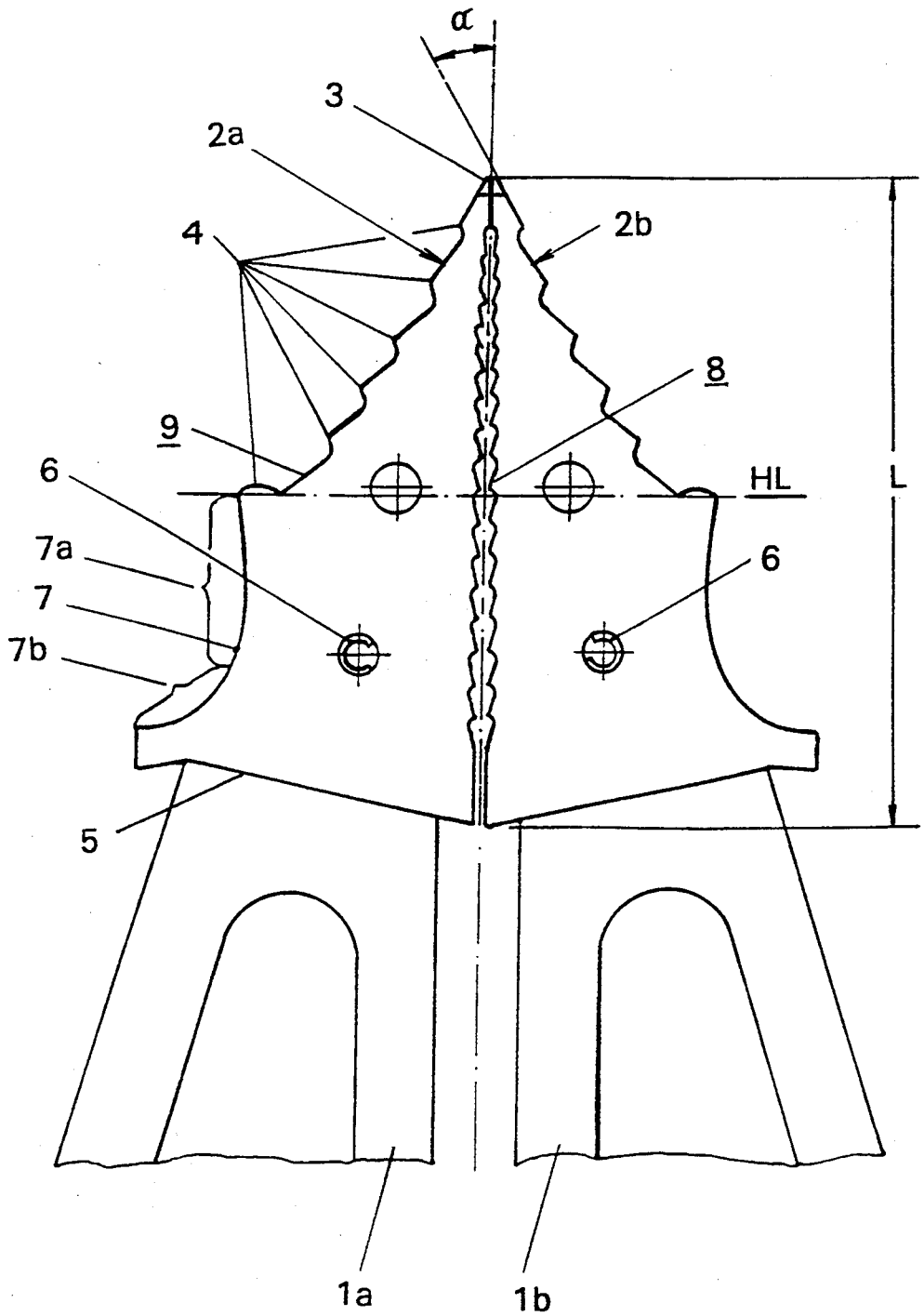
α
3
2a
2b
4
8
9
6
HL
L
7a
7
7b
6
5
1a
1b

SPREADER DEVICE WITH REPLACEABLE SPREADING JAWS

FIELD OF THE INVENTION

This invention relates to spreader devices for piercing an automobile body to make a hole therein and then enlarging such hole sufficiently to enable persons trapped in the automobile to be evacuated.

BACKGROUND OF THE INVENTION

Spreader devices having replaceable spreading elements or jaws are generally known. Frequently such devices are used as so-called rescue devices (rescue spreaders) in that they are used for opening a vehicle involved in an accident so that the passengers may be evacuated. Examples of rescue spreaders are disclosed in W. Kuhlmann, D. Hesse and K. Kogel U.S. Pat. No. 5,060,502 issued on Oct. 29, 1991 and entitled HYDRAULICALLY OPERATED STRIPPING DEVICE.

Some prior art spreader devices generally consist of scissor-like arms that are operated by the piston rod of a hydraulically actuated cylinder, and replaceable spreader jaws are mounted on these scissor-like arms. These spreader jaws are shaped differently depending on their purpose. That is, different shapes are necessary so that, for instance, doors can be separated from their hinges, holes can be cut directly into the passenger compartment and parts which have been pressed into each other can be pulled apart. Spreader jaws which can be used in a universal manner are also known, but up to now they were a compromise solution in that the design of such spreader jaws was effected for one main purpose, for instance the cutting of holes, and jaws of that same design when used for any other purpose constituted a compromise.

SUMMARY OF THE INVENTION

It is the object of this invention to construct the replaceable spreader jaws of a spreader device in such a manner that they can be used effectively for many applications which may occur.

This object is achieved in accordance with our invention by providing a pair of back-to-back spreader jaws each of which includes a point or tip disposed remote from the arm on which the jaw is mounted. Converging front and back sides of the jaw are arranged at an angle of approximately 20° to 30°. These sides extend from a base of the jaw and meet at the tip.

Proceeding along the front side from the tip halfway to the base, there is at least one metal piercing tooth, and from that halfway point to the base there is a cam comprising two circular segments the first of which has a radius of approximately 0.4 to 0.8 times the length of the back side and the second of which has a radius of approximately 0.1 to 0.3 times the length of the back side. These cam segments are used for support and they facilitate rolling on round parts such as columns, spars, etc. For protection against slippage, corrugations are formed along the back side.

BRIEF DESCRIPTION OF THE DRAWING

The foregoing object as well as other objects of the instant invention shall become apparent after reading the following description of the accompanying drawing in which the single FIGURE is a side elevation of a pair of spreader jaws constructed in accordance with this invention.

DETAILED DESCRIPTION OF THE DRAWING

Now referring to the drawing wherein replaceable spreader jaws 2*a*, 2*b* are shown mounted back-to-back on respective arms 1*a*, 1*b* of a rescue spreader, which is not shown in detail. Spreader jaws 2*a*, 2*b* are triangular elements that are mirror images of each other, so that only one of them (jaw 2*b*) shall be described in detail.

Spreader jaw 2*b* includes corrugated side 8 and shaped front side 9 that extend from base 5 and converge at tip 3. The included angle $\alpha$ between back and front sides 8, 9 is approximately from 20° to 30°. Bases 5, 5 are provided with openings (not shown) that receive respective scissor arms 1*a*, 1*b*. An individual bolt 6 secures each jaw 2*a*, 2*b* to respective arms 1*a*, 1*b*.

There are a plurality of teeth 4 along the approximate half length of front side 9 that extends from tip 3 to line HL. The latter is perpendicular to back side 8 and intersects same at its midpoint. While six teeth 4 are illustrated in the drawing, a single tooth may be sufficient for a particular job. Along front side 9 for its other half length, between line HL and base 5, there is a cam 7 comprising a relatively longer circular segment 7*a* and a relatively shorter circular segment 7*b*, the latter being interposed between longer segment 7*a* and base 5. The radius of longer segment 7*a* is approximately 0.5 to 0.8 times length L of back side 8 and the radius of shorter segment 7*b* is approximately 0.1 to 0.3 time length L.

The configuration of spreader jaws 2*a*, 2*b* enables them to be used for both spreading and peeling. Cam 7 enables jaws 2*a*, 2*b* to be supported by and roll on round parts such as columns, while the corrugations along back side 8 increase protection against slippage.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spreader device comprising replaceable first and second jaws operatively positioned back-to-back, each of said jaws being generally triangular and including:

a base, a back side and a front side, both of said sides extending from said base and converging with each other at a tip;

said front side in its first half length, which extends from said tip, having tooth means and in its second half length, which extends from said base, having a curved cam;

said curved cam comprising generally circular first and second segments, with said second segment being interposed between said first segment and said base;

said first segment being of a larger radius than said second section.

2. A spreader device as set forth in claim 1 in which the tooth means includes a plurality of teeth.

3. A spreader device as set forth in claim 2 in which the plurality of teeth comprises as many as six teeth.

4. A spreader device as set forth in claim 1 in which the tooth means comprises at least one tooth.

5. A spreader device as set forth in claim 4 in which the front side and back side intersect at an included angle of approximately 20° to 30°.

6. A spreader device as set forth in claim 1 in which the front side and back side intersect at an included angle of approximately 20° to 30°.

7. A spreader device as set forth in claim 1 in which said back side is of length L, said first segment is of a radius that is approximately 0.4 to 0.8 times length L, and said second segment is of a length that is approximately 0.1 to 0.3 times length L.

8. A spreader device as set forth in claim 7 in which said first segment is longer than said second segment.

9. A spreader device as set forth in claim 7 in which the front side and back side intersect at an included angle of approximately 20° to 30°.

10. A spreader device as set forth in claim 9 in which said back side, for a vast majority of its length, is corrugated.

11. A spreader device as set forth in claim 10 in which said first segment is longer than said second segment.

12. A spreader device as set forth in claim 1 in which said back side is corrugated for a vast majority of its length.

* * * * *